US007665726B2

(12) United States Patent
Kotera

(10) Patent No.: US 7,665,726 B2
(45) Date of Patent: Feb. 23, 2010

(54) PAPER FEEDER CASSETTE AND IMAGE FORMING DEVICE

(75) Inventor: Shinichi Kotera, Nara (JP)

(73) Assignee: Kyocera Mita Corporation (JP)

( * ) Notice: Subject to any disclaimer, the term of this patent is extended or adjusted under 35 U.S.C. 154(b) by 76 days.

(21) Appl. No.: 12/126,633

(22) Filed: May 23, 2008

(65) Prior Publication Data

US 2008/0296832 A1 Dec. 4, 2008

(30) Foreign Application Priority Data

May 29, 2007 (JP) ..... 2007-141617
Jun. 28, 2007 (JP) ..... 2007-170204

(51) Int. Cl.
*B65H 1/00* (2006.01)

(52) U.S. Cl. ..... 271/145; 271/171

(58) Field of Classification Search ..... 271/145, 271/171; 399/393
See application file for complete search history.

(56) References Cited

U.S. PATENT DOCUMENTS 5,611,528 A * 3/1997 Nakamura et al. ..... 271/164
2004/0070138 A1* 4/2004 Ishikuro ..... 271/171
2006/0222434 A1* 10/2006 Kitamura et al. ..... 400/624
2007/0114713 A1* 5/2007 Yonemoto ..... 271/171
2007/0189822 A1* 8/2007 Nakamura ..... 399/393

FOREIGN PATENT DOCUMENTS

JP H04-100131 U 8/1992
JP H11-139572 A 5/1999

* cited by examiner

*Primary Examiner*—David H Bollinger
(74) *Attorney, Agent, or Firm*—Ostrolenk Faber LLP

(57) ABSTRACT

A paper feeder cassette includes a bottom part, a pair of support plates that moves relative to the bottom part and supports the both lateral sides of the sheets of paper in a paper width direction perpendicular to a paper transporting direction, and a paper disposition plate that is disposed above the bottom part and disposes the sheet of paper thereon and includes an edge portion provided along a direction approximately perpendicular to the paper transporting direction on the downstream side of the pair of the support plates in the paper transporting direction and a contact avoidance portion for preventing the sheets of paper from making contact with the edge portion when disposition of the sheets of paper are performed by sliding the sheets of paper along the paper transporting direction.

17 Claims, 11 Drawing Sheets

PAPER FEEDER CASSETTE AND IMAGE FORMING DEVICE

CROSS-REFERENCE TO RELATED APPLICATIONS

This application claims priority to Japanese Patent Application Nos. 2007-141617 and 2007-170204, the entirety of which are hereby incorporated by reference.

BACKGROUND OF THE INVENTION

1. Field of the Invention

The present invention relates to a paper feeder cassette, especially to a paper feeder cassette that is attached to an image forming device and stores a plurality of sheets of paper for printing to be supplied to an image forming section and the like. In addition, the present invention relates to an image forming device including the paper feeder cassette.

2. Background Information

An electrophotographic type image forming device includes an image forming section that forms an image onto a sheet of paper based on image information, a fixing section for fixing the image formed by the image forming section onto a sheet of paper, a paper feeding section for storing a sheet of paper that forms an image on its surface, and a paper transporting section for transporting a sheet of paper to the image forming section and the fixing section. In the image forming device, a sheet of paper fed from the paper feeding section is transported to the image forming section, and an image is formed on the sheet of paper by the image forming section based on the image information. Then, the sheet of paper on whose surface the image is formed by the image forming section is transported to the fixing section by the paper transporting section, and the image is fixed onto the sheet of paper by the fixing section. The sheet of paper onto which an image is fixed is discharged to the outside of the image forming device.

Here, the paper feeding section includes a paper feeder cassette that stores a plurality of sheets of paper to be used for printing, rollers for feeding a sheet of paper to the paper transporting section, and the like. As described in Japanese Utility Model Publication No. JP-U-H04-100131 and Japanese Patent Application Publication No. JP-A-H11-139572, the paper feeder cassette includes a bottom part, a disposition plate that is disposed above the bottom part and disposes a plurality of sheets of paper thereon, and a pair of support plates that moves relative to the bottom part and supports both width-directional sides of a sheet of paper. In addition, the disposition plate is generally configured that its one end moves to an upper side when it rotates around its other end. In this type of paper feeder cassette, a cutout is formed in the both width-directional ends of the disposition plate in order to prevent the disposition plate from interfering with the pair of support plates when one end of the disposition plate moves in the up-and-down direction.

As described above, a cutout is formed in both width-directional end portions of the disposition plate in the conventional paper feeder cassette. Accordingly, it is difficult to avoid that an edge portion is formed on the brim of the cutout. On the other hand, when a plurality of sheets of paper is supplied to the paper feeder cassette of this type, one end of the bundle of paper is often disposed on the disposition plate, and the bundle of paper is arranged in an appropriate position on the disposition plate while being slid in a paper transporting direction. During the paper supply operation, the end of the bundle of paper gets stuck with the edge portion formed on the brim of the cutout of the disposition plate, and may be prevented from being smoothly disposed on the disposition plate.

Also, some of the paper feeder cassettes may be configured to have a pair of support plates with a protrusion for supporting a sheet of paper. Here, the protrusion protrudes from the support plates in a direction approximately perpendicular to the support plate. When a plurality of sheets of paper is set in the paper feeder cassette of this type, the sheets of paper may be disposed between the pair of support plates while being slid between the pair of support plates. In this case, the sheets of paper get stuck with the protrusion, and thus it is difficult to dispose the sheets of paper on the paper feeder cassette.

In view of the above, it will be apparent to those skilled in the art from this disclosure that there exists a need for an improved paper feeder cassette and image forming device. This invention addresses this need in the art as well as other needs, which will become apparent to those skilled in the art from this disclosure.

SUMMARY OF THE INVENTION

An object of the present invention is to prevent a plurality of sheets of paper from getting stuck with an edge portion of a paper disposition plate when the sheets of paper are supplied to a paper feeder cassette.

Another object of the present invention is to prevent a plurality of sheets of paper from easily getting stuck with, against, or by a protrusion of a support portion.

A paper feeder cassette according to a first aspect of the present invention is a paper feeder cassette that is configured to be attached to an image forming device and is configured to store a plurality of sheets of paper to be transported to an image forming section of the image forming device, and includes a bottom part, a pair of support plates, and a paper disposition plate. The pair of support plates is configured to move relative to the bottom part, and supports the both lateral sides of the sheets of paper in a paper width direction perpendicular to a paper transporting direction. The paper disposition plate is disposed above the bottom part, and is configured to dispose the sheets of paper thereon. In addition, the paper disposition plate includes an edge portion and a contact avoidance portion. The edge portion is provided to extend along a direction approximately perpendicular to the paper transporting direction on the downstream side of the pair of the support plates in the paper transporting direction. The contact avoidance portion is configured to prevent the sheets of paper from making contact with the edge portion when disposition of the sheets of paper are performed by sliding the sheets of paper along the paper transporting direction.

In the paper feeder cassette, when the sheets of paper are disposed, the two support plates are moved relative to the bottom part in accordance with the size of the sheets of paper to be disposed, and the sheets of paper are disposed between the pair of the support plates from above. Here, when the sheets of paper are generally supplied to the paper feeder cassette, disposition of the sheets of paper are often performed while the sheets of paper are slid between the pair of support plates along a paper transporting direction. Here, a cutout is often formed in the paper disposition plate considerating the attachment of other members. When the cutout is formed, an edge portion is accordingly generated. Therefore, when the sheets of paper are supplied, ends of the sheets of paper often get stuck with the edge portion.

However, in the present invention, it is possible to prevent the sheets of paper from making contact with the edge portion by providing the contact avoidance portion when the sheets of paper are disposed on the paper disposition plate while they are sliding between the pair of support plates. Thus, it is possible to prevent the sheets of paper from getting stuck with the edge portion. Due to this structure, it becomes easy to dispose the sheets of paper on the paper disposition plate.

A paper feeder cassette according to a second aspect of the present invention is the paper feeder cassette of the first aspect, wherein the pair of the support plates includes a support disposition portion that is configured to dispose a part of the sheet of paper thereon. In addition, the paper disposition plate further includes paper disposition portions disposed in parallel with each other on the bottom part. The contact avoidance portion is provided between the paper disposition portion and the edge portion and is formed to be bent from the paper disposition portion to the bottom portion side. The edge portion is positioned below the height position of the support disposition portion of the pair of the support plates by the contact avoidance portion.

Here, the edge portion is disposed below the height position of the support disposition plate. Therefore, it is possible to prevent ends of the sheets of paper from getting stuck with the edge portion.

A paper feeder cassette according to a third aspect of the present invention is the paper feeder cassette of the second aspect, wherein the upstream side's end of the paper disposition plate in the paper transporting direction is rotatably supported.

Here, it is possible to locate an end of a sheet of paper in a paper feeding position by rotating the paper disposition plate around the upstream side's end of the paper disposition plate in the paper transporting direction.

A paper feeder cassette according to a fourth aspect of the present invention is the paper feeder cassette of the first aspect, wherein the bottom part includes a groove portion that is configured to receive the edge portion and the contact avoidance portion by insertion.

Here, the edge portion and the contact avoidance portion make contact with the bottom part, and accordingly it is possible to prevent an end of the paper disposition plate from being lifted up. Therefore, it is possible to prevent the contact avoidance portion from being an obstacle to the sheets of paper when disposition of the sheets of paper are performed by sliding the sheets of paper.

A paper feeder cassette according to a fifth aspect of the present invention is the paper feeder cassette of the second aspect, wherein the paper disposition portion includes an opening in the vicinity of the contact avoidance portion, and the contact avoidance portion includes a twisted portion that is provided to connect a bent portion and the paper disposition portion and forms a part of a brim of the opening.

Here, for example, an opening (cutout) for a sensor that is configured to detect the existence of a sheet of paper may be provided in the paper disposition plate. In this case, when a part of the opening is formed to be opened, strength of the part in which the opening is formed is reduced.

In response to this, according to the present invention, a twisted portion to connect a bent portion of the contact avoidance portion and the paper disposition portion is provided for the purpose of preventing strength reduction of the part in which the opening is formed, and forms a part of the brim of the opening. Due to this structure, it is possible to inhibit strength reduction even if the opening is formed.

A paper feeder cassette according to a sixth aspect of the present invention is the paper feeder cassette of the first aspect, wherein the paper disposition plate includes a first width direction portion, a longitudinal direction portion, a second width direction portion, and a connection portion. The first width direction portion is provided on an upstream side's end of the paper disposition plate in the paper transporting direction, and extends in the paper width direction. The longitudinal direction portion extends from the first width direction portion to the downstream side in the paper transporting direction. The second width direction portion includes a cutout in a portion connected to the longitudinal direction portion, and the cutout is formed to extend in the paper transporting direction from the upstream side in the paper transporting direction. In addition, the second width direction portion is provided on a downstream side's end of the longitudinal direction portion in the paper transporting direction, and extends in the paper width direction. The connection portion that connects the second width direction portion and the longitudinal direction portion is bridged between the second width direction portion and the longitudinal direction portion in an oblique direction with respect to the paper width direction so as to cross the cutout.

Here, when the sheets of paper are disposed on the paper disposition plate while being slid along the paper transporting direction, it is possible to slide smoothly the sheets of paper in the paper transporting direction by the connection portion. Accordingly, it is possible to prevent the sheets of paper from getting stuck with the edge portion.

An image forming device according to a seventh aspect of the present invention includes a paper feeder cassette that is configured to store a plurality of sheets of paper to be used for printing, an image forming section that is configured to form an image on the sheet of paper, and a paper transporting section that is configured to transport the sheets of paper stored in the paper feeder cassette to the image forming section. The paper feeder cassette includes a bottom part, a pair of support plates, and a paper disposition plate. The pair of support plates is configured to move relative to the bottom part, and is configured to support the both lateral sides of the sheets of paper in a paper width direction perpendicular to a paper transporting direction. The paper disposition plate is disposed above the bottom part, and is configured to dispose the sheets of paper thereon. The paper disposition plate includes an edge portion and a contact avoidance portion. The edge portion is provided along a direction approximately perpendicular to the paper transporting direction on the downstream side of the pair of the support plates in the paper transporting direction. The contact avoidance portion is configured to prevent the sheets of paper from making contact with the edge portion when disposition of the sheets of paper are performed by sliding the sheets of paper along the paper transporting direction.

A paper feeder cassette according to an eighth aspect of the present invention is configured to be attached to an image forming device and is configured to store a plurality of sheets of paper to be used for printing.

The paper feeder cassette includes a paper disposition plate that is configured to dispose the sheets of paper thereon, and a pair of support plates that is configured to support both lateral sides of the sheets of paper disposed on the paper disposition plate in a paper width direction. Each of the pair of support plates includes a lateral portion and a support projection. The lateral portion has a predetermined height, extends in a paper transporting direction perpendicular to the paper width direction, and is opposed to a lateral side of the sheets of paper. The support projection is formed to project from the lateral portion toward the sheets of paper, and is configured to make contact with the lateral side of the sheets of paper. An insertion guide lateral surface of the support projection on the upstream side in a paper insertion direction is sloped from a paper abutment surface of the support projection to the lateral portion.

In the paper feeder cassette of the image forming device, when a plurality of sheets of paper to be used for printing is supplied thereto, the sheets of paper are disposed on the paper disposition plate and the both lateral sides of the sheets of paper in the width direction are supported by the pair of the support plates. Here, the sheets of paper are disposed on the paper disposition plate between the pair of support plates from the above of the paper disposition plate. Alternately, the sheets of paper are disposed between the pair of the support plates by inserting the sheets of paper from the upstream side in a paper insertion direction when the sheets of paper are disposed on the paper disposition plate. Here, the term "paper insertion direction" means a direction from the upstream side of the pair of the support plates in the paper transporting direction and from the above of the pair of the support plates, to a position between the pair of the support plates. Due to this structure, the sheets of paper are supposed to be slid between the pair of the support plates when the sheets of paper are inserted from the upstream side in the paper insertion direction. Here, it is possible to prevent the sheets of paper from getting stuck with the support projection and thus it becomes easy to insert the sheets of paper, because the insertion guide lateral surface of the support projection on the upstream side in the paper insertion direction is sloped from the paper abutment surface of the support projection to the lateral portion.

A paper feeder cassette according to a ninth aspect of the present invention is the paper feeder cassette of the eighth aspect, wherein the insertion guide lateral surface is formed to have the mold draft angle sloped upward from the bottom part.

Here, when manufacturing is performed with a mold, it becomes easy to pull the mold upward from the bottom part.

A paper feeder cassette according to a tenth aspect of the present invention is the paper feeder cassette of the eighth aspect, wherein a surface of the lateral portion opposed to the lateral side of the sheets of paper are formed to have mold draft angle sloped upward from the bottom part.

Here, when manufacturing is performed with a mold, it becomes easy to pull the mold upward from the bottom part.

A paper feeder cassette according to an eleventh aspect of the present invention is the paper feeder cassette of the eighth aspect, and a downstream side lateral surface of the support projection in the paper insertion direction is formed to have mold draft angle sloped upward from the bottom part.

Here, when manufacturing is performed with a mold, it becomes easy to pull the mold upward from the bottom part.

A paper feeder cassette according to a twelfth aspect of the present invention is the paper feeder cassette of the eighth aspect, and each of the pair of the support plates further includes a bottom portion on the bottom of the lateral portion. The bottom portion is integrally formed with the lateral portion. In addition, the bottom portion is attached to be in parallel with the paper disposition plate, and is attached to slide in the paper width direction with respect to the paper disposition plate.

Here, it becomes easy to support a bundle of paper with the pair of support plates.

An image forming device according to a thirteenth aspect of the present invention includes a paper feeder cassette that is configured to store a plurality of sheets of paper to be used for printing, an image forming section that is configured to form an image on the sheets of paper, and a paper transporting section that is configured to transport the sheet of paper stored in the paper feeder cassette to the image forming section. Here, the paper feeding cassette includes a paper disposition plate that is configured to dispose the sheets of paper thereon, and a pair of support plates that is configured to support both lateral sides of the sheets of paper disposed on the paper disposition plate in a paper width direction. In addition, each of the pair of support plates includes a lateral portion and a support projection. The lateral portion has a predetermined height, extends in a paper transporting direction perpendicular to the paper width direction, and is opposed to a lateral side of the sheet of paper. The support projection is formed to project from the lateral portion toward the sheets of paper, and is configured to make contact with the lateral side of the sheets of paper. An insertion guide lateral surface of the support projection on the upstream side in a paper insertion direction is sloped from a paper abutment surface of the support projection to the lateral portion.

A paper feeder cassette according to a fourteenth aspect of the present invention is a paper feeder cassette that is configured to be attached to an image forming device and is configured to store a sheet of paper to be transported to an image forming section of the image forming device. The paper feeder cassette includes a bottom part, a paper disposition plate, a friction member, and a sloped member. The paper disposition plate includes a flat portion and a recessed portion. The flat portion is disposed above the bottom part, and is configured to dispose a plurality of sheets of paper on the upper surface thereof. The recessed portion is formed in a part of the flat portion so as to protrude downward from the flat portion. The friction member is configured to prevent a plurality of sheets of paper from being simultaneously transported from the paper disposition plate while the sheets of paper are overlapped, and is configured to make contact with the bottom surface of the sheet of paper to be transported from the paper disposition plate. The sloped member is disposed on the upstream side in a paper transporting direction of the friction member so as to be adjacent to the friction member. The sloped member has an end portion, the end portion is positioned higher than the friction member, on the downstream side in the paper transporting direction, and has a surface sloped toward the upstream side in the paper transporting direction. The sloped member is disposed on the upstream side of the friction member in a paper transporting direction so as to be adjacent to the friction member. The sloped member has a surface sloped toward an upstream side in the paper transporting direction, and the surface has a downstream side's end in the transporting direction, which is positioned higher than the friction member.

A paper feeder cassette according to a fifteenth aspect of the present invention is the paper feeder cassette of the fourteenth aspect, wherein the friction member is disposed in the recessed portion of the paper disposition plate.

A paper feeder cassette according to a sixteenth aspect of the present invention is the paper feeder cassette of the fourteenth aspect, and further includes a pair of support plates that is configured to move relative to the bottom part and is configured to support both lateral sides of the sheet of paper in a paper width direction perpendicular to the paper transporting direction.

A paper feeder cassette according to a seventeenth aspect of the present invention is the paper feeder cassette of the sixteenth aspect, wherein the paper disposition plate includes an edge portion and a contact avoidance portion. Here, the edge portion is disposed along a direction approximately perpendicular to the paper transporting direction on the downstream side of the pair of the support plates in the paper transporting direction. The contact avoidance portion is configured to prevent a plurality of sheets of paper from making contact with the edge portion when disposition of the sheets of paper are performed by sliding the sheets of paper along the paper transporting direction. In addition, the recessed portion is formed to be adjacent to the contact avoidance portion on the downstream side of the contact avoidance portion in the paper transporting direction.

According to the present invention, sheets of paper do not easily get stuck with, by, or against an edge portion of a paper disposition plate.

In addition, according to the present invention, sheets of paper do not easily get stuck with, by, or against protrusions of a pair of support plates.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

1. First Embodiment

Entire Configuration

Figure 1:
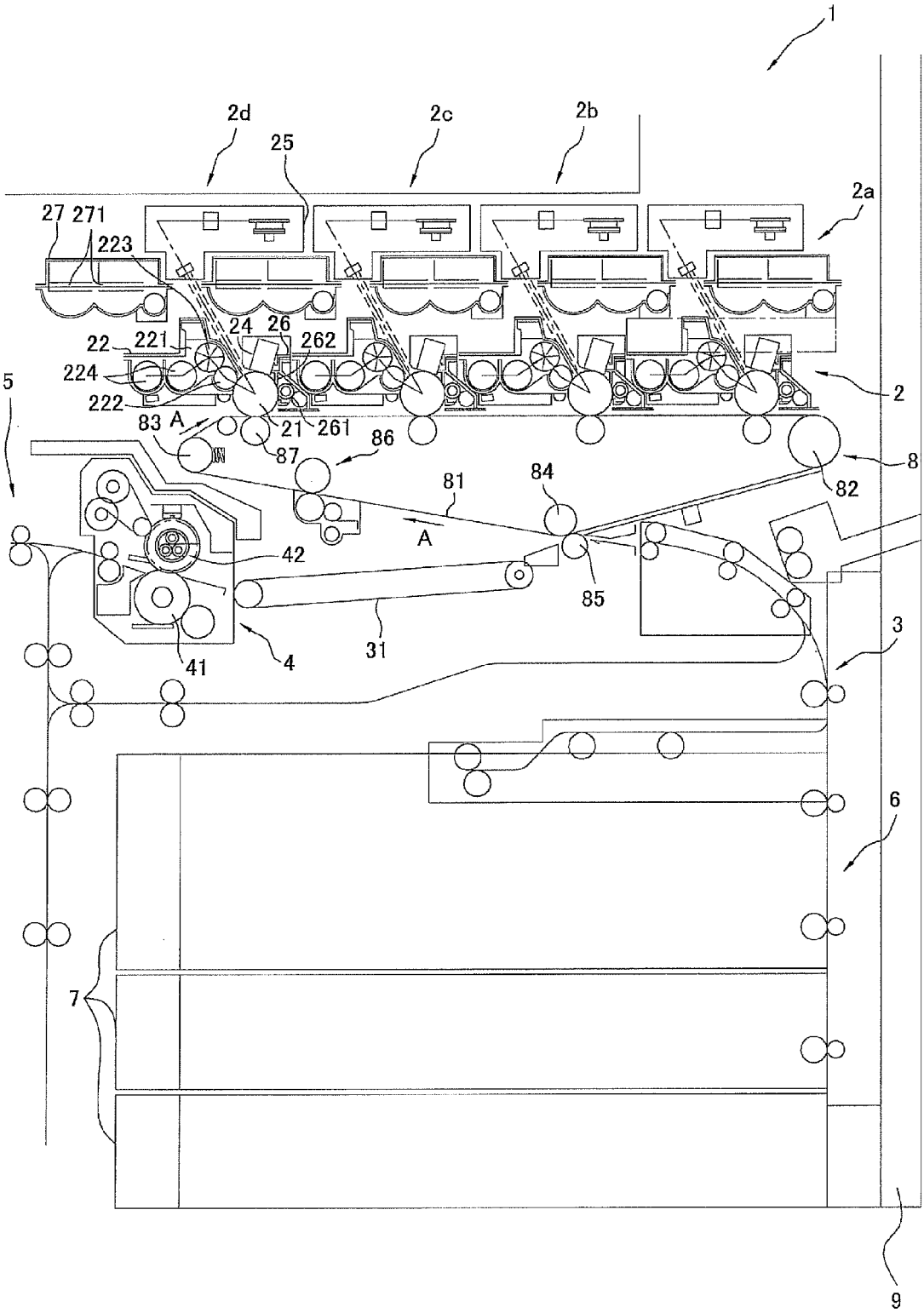
FIG. 1 is a schematic cross-sectional view of a color printer in accordance with a first preferred embodiment of the present invention.

FIG. 1 illustrates a color printer 1, which is an image forming device of an embodiment of the present invention. Note that FIG. 1 is a cross-sectional schematic view of a diagram illustrating the arrangement of elements of the color printer 1, and detailed illustration of some of the elements is omitted. Also, Arrow A in FIG. 1 indicates a circulation direction of an intermediate transfer belt 81.

The color printer 1 is preferably connected to a computer (not illustrated in the figure) and the like. The color printer 1 is a device that prints a color image on a sheet of paper based on image information transmitted from the outer computer and the like.

The color printer 1 includes an image forming section 2 that is configured to form an image based on the image information, a paper transporting section 3 that is configured to transport a sheet of paper, a fixing section 4 that is configured to fix the image formed by the image forming section 2 onto a sheet of paper, a discharging section 5 that is configured to discharge the sheet of paper to the upper portion of the color printer 1, a paper feeding section 6 that is configured to store a plurality of sheets of paper, a transfer device 8 that is configured to transfer the image onto a sheet of paper, and an outer framework 9 (device body).

The image forming section 2 preferably includes four toner image forming units 2*a*, 2*b*, 2*c*, and 2*d*, each of which are configured to form a toner image. Here, colors of the toner images formed by the toner image forming units 2*a*-2*d* are different from each other. The toner image forming units 2*a*-2*d* are disposed to be aligned in a line in the horizontal direction. As illustrated in FIG. 1, each of the toner image forming units 2*a*-2*d* includes a photosensitive drum 21, a developing device 22, an electric charging device 24, an exposing device 25, a cleaning device 26, and a toner container 27. Here, the toner image forming unit 2*a* is preferably a unit that is configured to form a black image. The toner image forming unit 2*b* is preferably a unit that is configured to form a yellow image. The toner image forming unit 2*c* is preferably a unit that is configured to form a cyan image. The toner image forming unit 2*d* is preferably a unit that is configured to form a magenta image.

The photosensitive drum 21 is a member that supports an electrostatic latent image that is formed based on the image information. The rotary shaft of the photosensitive drums 21 extends in a direction perpendicular to the drawing illustrated in FIG. 1.

The developing device 22 is a device that is configured to supply toner to the photosensitive drum 21, and is disposed to be adjacent to the photosensitive drum 21. The developing device 22 has a developer storing space 221, which is configured to store developer, in its interior, and also includes a developing roller 222, a magnetic roller 223, and two diffusing members 224. The developing roller 222 is disposed to be opposed to the photosensitive drum 21, and is a member that is configured to supply toner stored in the developer storing space 221 to the photosensitive drum 21. The magnetic roller 223 is a roller that is configured to supply the toner stored in the developer storing space 221 to the developing roller 222. The diffusing members 224 are members that are configured to diffuse the toner stored in the developer storing space 221.

The electric charging device 24 is a device that is configured to charge electrically the surface of the photosensitive drum 21, and is disposed below and adjacent to the photosensitive drum 21.

The exposing device 25 is a part that is configured to irradiate light on the photosensitive drum 21 based on the image information. The exposing device 25 is disposed above the photosensitive drum 21, and is also disposed to irradiate light between the electric charging device 24 and the developing device 22. Specifically, the exposing device 25 is disposed above the developing device 22 and the toner container 27.

The cleaning device 26 is a device that is configured to clean toner that remains that was not transferred from the photosensitive drum 21, and includes a cleaning roller 261 and a cleaning blade 262. In addition, the cleaning device 26 is disposed lateral to and adjacent to the photosensitive drum 21. The cleaning roller 261 is a member that is configured to remove toner left on the surface of the photosensitive drum 21 after the transfer and accumulate it in the interior of the cleaning device 26, and is disposed in parallel with the rotary shaft of the photosensitive drum 21. The cleaning blade 262 is disposed to be adjacent to the photosensitive drum 21. The cleaning blade 262 is a member that is configured to scrape away the toner left on the photosensitive drum 21 without being removed by the cleaning roller 261 and recovers it in the interior of cleaning device 26.

The toner container 27 is a member that is configured to store toner that is allowed to be supplied to the developing device 22. Here, five toner containers 27 are disposed to be aligned in the horizontal direction. Specifically, the five toner containers 27 respectively store magenta toner, cyan toner, yellow toner, black toner, and black toner sequentially from left to right in FIG. 1. When the amount of toner stored in the developing device 22 is reduced, toner is supplied from the toner container 27 to the developing device 22. In addition, the toner container 27 includes two agitating members 271 in its interior, and the agitating members 271 are configured to agitate toner. Here, two toner containers 27 storing black toner are connected to one of the developing devices 22. Also, black toner is used for both the monochrome image forming operation and the color image forming operation, and is most consumed toner among the magenta, cyan, yellow and black toners. Due to this structure, the two toner containers 27 storing black toner are herein disposed.

The paper transporting section 3 is a section that is configured to sequentially transport a sheet of paper stored in the paper feeding section 6 to the image forming section 2, the fixing section 4, and the discharging section 5, and includes a transporting belt 31.

The fixing section 4 is a section for fixing an image formed on a sheet of paper by the image forming section 2, and includes a pressing roller 41 and a heating roller 42.

The discharging section 5 is a section that is configured to discharge the sheet of paper on whose surface an image is fixed to the outside of the color printer 1, and is disposed on the lateral part of the color printer 1.

The paper feeding section 6 includes a plurality of paper feeder cassettes 7 that is configured to store a variety of types of paper. In addition, the paper feeding section 6 is preferably disposed on the bottom of the color printer 1. The paper feeder cassettes 7 will be explained in the following paragraphs.

The transfer device 8 is a device that is configured to transfer an image formed on each of the photosensitive drums 21 to a sheet of paper, and is preferably disposed below the photosensitive drums 21. In addition, the transfer device 8 includes an intermediate transfer belt 81, a driving roller 82, a tension roller 83, a first transfer roller 84, a second transfer roller 85, a belt cleaning device 86, and a belt support roller 87. The intermediate transfer belt 81 is a looped belt, and supports an image on its surface. The driving roller 82 is a roller that is configured to circulate the intermediate transfer belt 81, and is rotated by a motor (not illustrated in the figure). The tension roller 83 is a member that is configured to apply tension to the intermediate transfer belt 81, and is disposed to be opposed to the driving roller 82. The first transfer roller 84 is a roller that is configured to cause the intermediate transfer belt 81 to make contact with a sheet of paper, and supports the intermediate transfer belt 81 from inside of the inner transfer belt 81. The second transfer roller 85 is a member that is configured to transfer the image on the intermediate transfer belt 81 to a sheet of paper together with the first transfer roller 84, and is disposed to be opposed to the first transfer roller 84. The belt cleaning device 86 is a device that is configured to clean the developer left on the surface of the intermediate transfer belt 81. The belt support roller 87 is a member that is configured to support the intermediate transfer belt 81 so as to cause the intermediate transfer belt 81 to make contact with the photosensitive drum 21, and is disposed to be opposed to the photosensitive drum 21.

The outer framework 9 is a member that disposes the image forming section 2, the fixing section 4, the transfer device 8, and the like in its interior.

Paper Feeder Cassette

Entire Configuration of Paper Feeder Cassette

Figure 2:
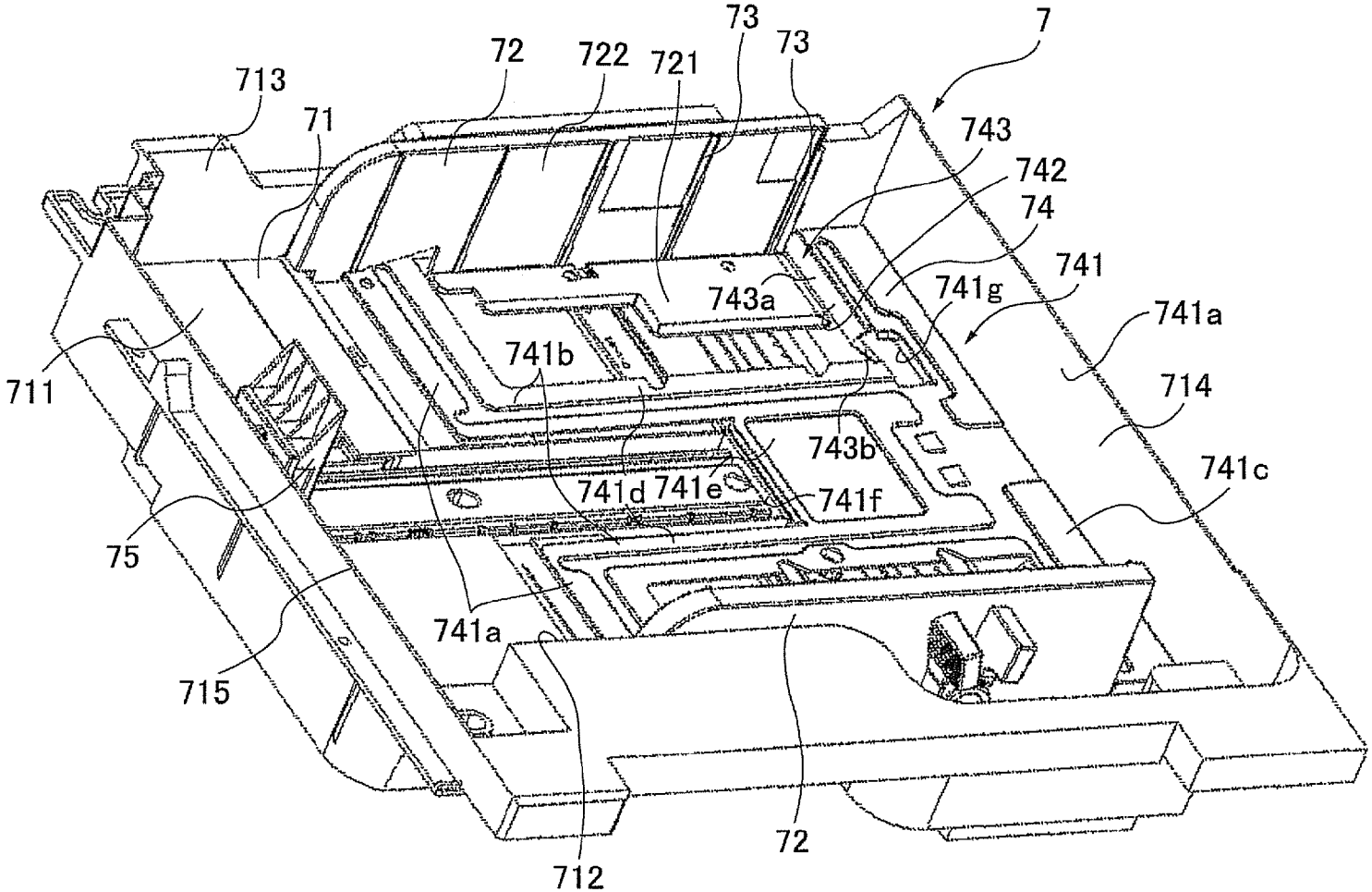
FIG. 2 is a perspective view of an entire paper feeder cassette of the color printer.

FIG. 2 is a perspective view illustrating one of the entire paper feeder cassettes 7. The paper feeder cassette 7 will be hereinafter explained with reference to FIG. 2. The paper feeder cassette 7 is a member that is configured to store a plurality of sheets of paper, and is disposed in the paper feeding section 6. The paper feeder cassette 7 includes a frame 71, a pair of support plates 72, a first paper disposition plate 74, and an alignment plate 75. Note that the term "paper transporting direction" to be described means a direction in which a sheet of paper is moved when the sheet of paper is fed from the paper feeder cassette 7 to the paper transporting section 3, in other words, a direction head from a fourth wall 715 (to be described) to a third wall 714 (to be described). In addition, the term "width direction" to be described means a direction that is approximately perpendicular to the paper transporting direction. Here, the paper feeder cassette 7 is configured to be pulled to the front side of FIG. 1.

Frame

Figure 3:
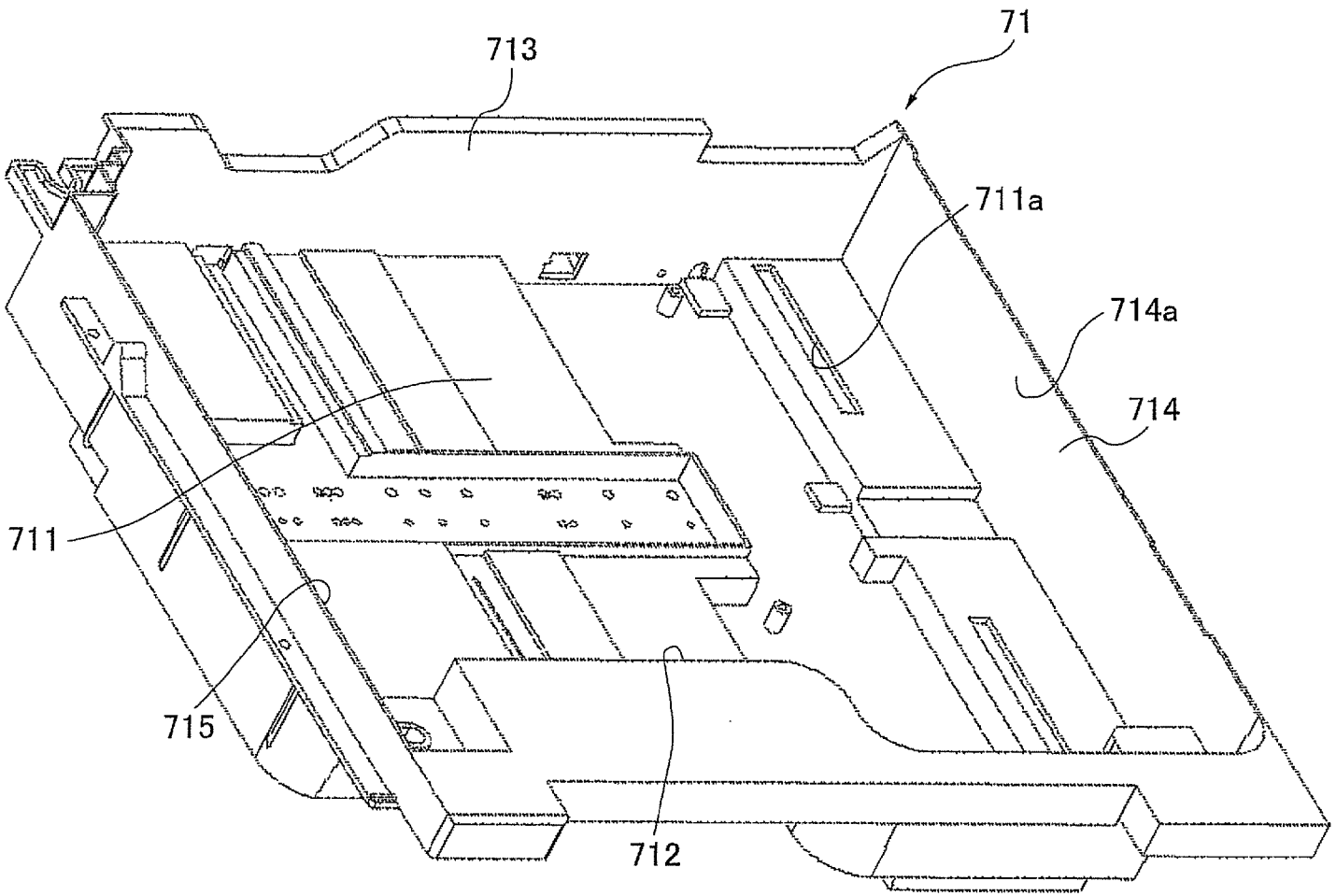
FIG. 3 is a view illustrating a groove formed on the bottom part of a frame of the paper feeder cassette.

As illustrated in FIG. 3, the frame 71 is a box shaped member, and includes a bottom portion or part 711, a first wall 712, a second wall 713, the third wall 714, and the fourth wall 715. The bottom portion 711 is a portion disposed on the bottom of the frame 71. Referring to FIGS. 2 and 3, in addition, a groove 711*a* is formed on the bottom portion 711 so as to be disposed between the first wall 712 and the second wall 713, and a part of the first paper disposition plate 74, more specifically, a part of an edge portion 742 (to be described) and the contact avoidance portion 743 are allowed to enter the groove 711*a*. Here, a plurality of sheets of paper is disposed in a paper disposition position. Specifically, a plurality of sheets of paper is disposed in a position between the pair of the support plates 72, and in a position between the alignment plate 75 and the third wall 714 of the frame 71. The first wall 712 is a portion that is provided on the front side (i.e., a side on which an operator is positioned when he/she performs an operation) of the color printer 1. Also, a drawer-pull (not illustrated in the figure) is formed in the first wall 712, and is allowed to be held by an operator when the paper feeder cassette 7 is pulled out of the color printer 1. The second wall 713 is disposed to be opposed to the first wall 712, and is a portion positioned on the rear side of the color printer 1. The third wall 714 is a portion disposed between the first wall 712 and the second wall 713, and includes a support surface 714*a* that is configured to support the longitudinal end of a plurality of sheets of paper. In addition, a sheet of paper is configured to be fed to the paper transporting section 3 from the above of the third wall 714. Here, the term "paper feeding position of a sheet of paper" to be described means a position where a sheet of paper is allowed to be fed to the paper transporting section 3 from the position on the first paper disposition plate 74. Specifically, the term means a position of a sheet of paper under the condition that an end of a sheet of paper is positioned above the third wall 714. The fourth wall 715 is disposed between the first wall 712 and the second wall 713, and is a portion that is disposed to be opposed to the third wall 714.

Pair of Support Plates

The pair of the support plates 72 is a pair of members that is configured to support the both lateral sides of a plurality of sheets of paper, specifically, both lateral sides of a plurality of sheets of paper in a direction perpendicular to the longitudinal direction (i.e., width direction of a sheet of paper), and is disposed to move in the width direction of a sheet of paper relative to the bottom portion 711. As illustrated in FIG. 2, each of the pair of the support plates 72 includes a support disposition portion 721 and a support portion 722. The support disposition portion 721 is a portion that is provided in parallel with the bottom portion 711, and disposes a part of a plurality of sheets of paper thereon. In addition, the support disposition portion 721 is attached to the support plate 72 so as to move in the paper width direction relative to the bottom portion 711. The support portion 722 is disposed in a direction approximately perpendicular to the support disposition portion 721. The surface of the support portion 722, which is opposed to the lateral side of a plurality of sheets of paper, is formed to be sloped from the bottom portion 711 so as to be gradually remote from the sheets of paper. In addition, the support portion 722 includes a plurality of support projections 73. The support projections 73 are portions that are configured to support a plurality of sheets of paper with its tip. The support projection 73 is formed to project from the support portion 722 of each of the pair of the support plates 72 toward a plurality of sheets of paper when a plurality of sheets of paper is disposed on the bottom portion 711.

First Paper Disposition Plate

As illustrated in FIG. 2 and FIGS. 4-6, the first paper disposition plate 74 is a member that disposes a plurality of sheets of paper thereon, and is disposed above the bottom portion 711. In addition, the first paper disposition plate 74 includes a paper disposition portion 741, the edge portion 742, and the contact avoidance portion 743.

Figure 4:
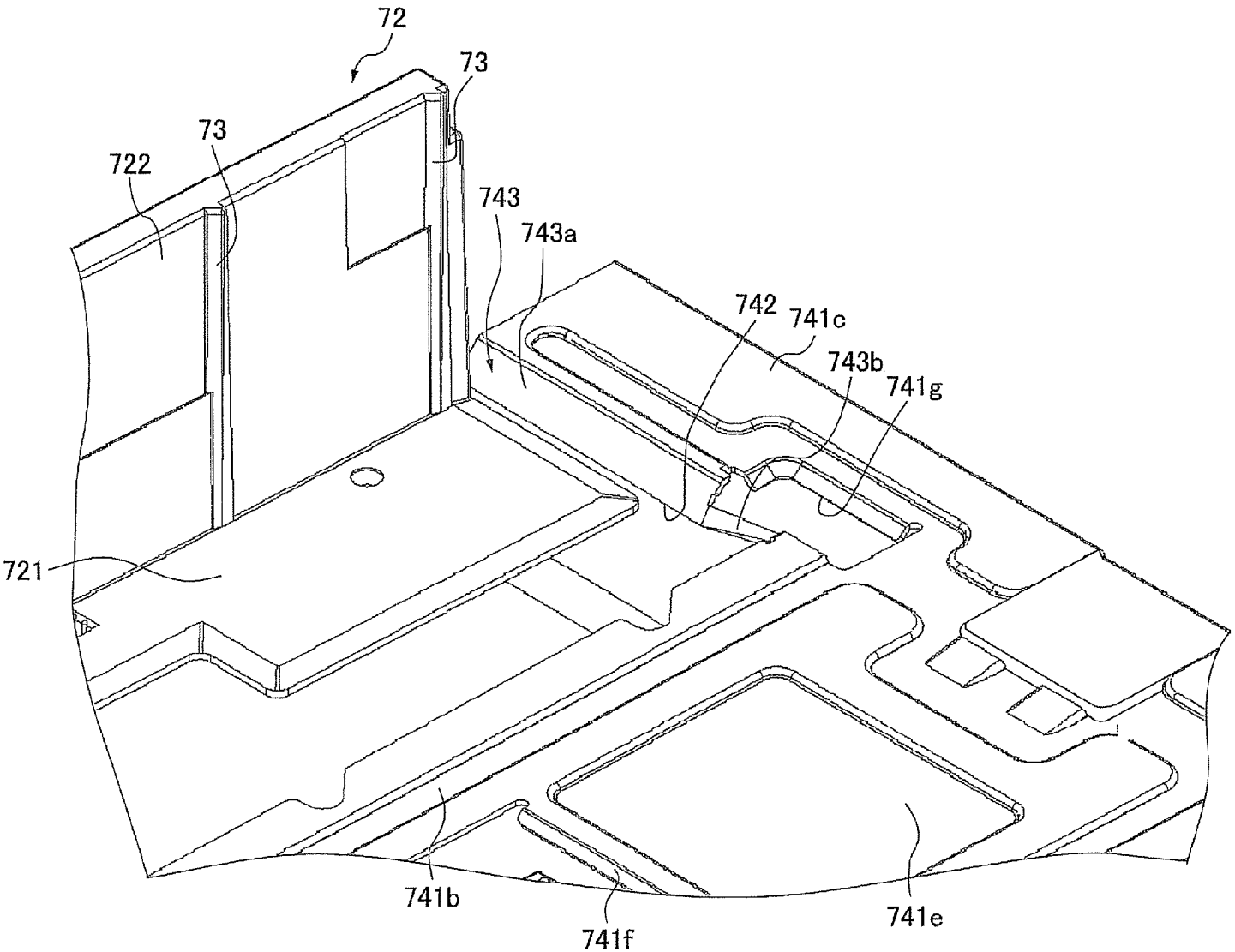
FIG. 4 is an enlarged view of an edge portion, a contact-avoidance portion, a hole, and their periphery of the paper feeder cassette.

The paper disposition portion 741 includes a first width direction portion 741*a*, a first longitudinal direction portion 741*b*, and a second width direction portion 741*c*. Both ends of the first width direction portion 741*a* are supported by the first wall 712 and the second wall 713 so as to be able to rotate around the first wall 712. The first width direction portion 741*a* is a portion that extends inward in the width direction from the supported ends. Note that the first paper disposition plate 74 is rotated around the first width direction portion 741*a*. In addition, the first width direction portion 741*a* is separated into two pieces in its center part, and the first longitudinal direction portion 741*b* is connected to the separated pieces. The first longitudinal direction portion 741*b* is a portion that extends along the paper transporting direction (i.e., direction approximately perpendicular to the width direction), and includes a pair of elongated plate portions 741*d* and a recessed portion 741*e*. Each of the pair of elongated plate portions 741*d* is disposed between the first width direction portion 741*a* and the second width direction portion 741*c*. The recessed portion 741*e* is formed between the pair of elongated plate portions 741*d*. Here, a connection portion 741 is formed in an upstream side end of the recessed portion 741*e* in the paper transporting direction, and is bent toward the bottom portion 711. Accordingly, when a plurality of sheets of paper is disposed on the first paper disposition plate 74 while being slid along the paper transporting direction, the sheets of paper do not easily get stuck with the connection potion 741*f*. The second width direction portion 741*c* is disposed along the third wall 714 in the vicinity of the third wall 714, and is a portion extending in the width direction. In addition, as illustrated in FIG. 4, an approximately rectangular shaped hole (cutout) 741*g* is formed in the second width direction portion 741*c*, specifically, in the vicinity of the connection portion between the second width direction portion 741*c* and the first longitudinal direction portion 741*b*. Accordingly, the second width direction portion 741*c* is configured not to block light-emission/receiving performed by a sensor (not illustrated in the figure) that is configured to detect whether a sheet of paper exists. Note that the rear side end portion of the hole 741*g* in the paper transporting direction is bent toward the bottom portion 711 side, and is positioned closer to the bottom portion 711 than to the support disposition portion 721. Accordingly, when a plurality of sheets of paper is disposed on the first paper disposition plate 74 while being slid in the paper transporting direction, the sheets of paper do not easily get stuck with the rear side end portion of the hole 741*g* in the paper transporting direction. Thus, the hole 741*g* is configured not to hinder disposition of a plurality of sheets of paper.

Figure 5:
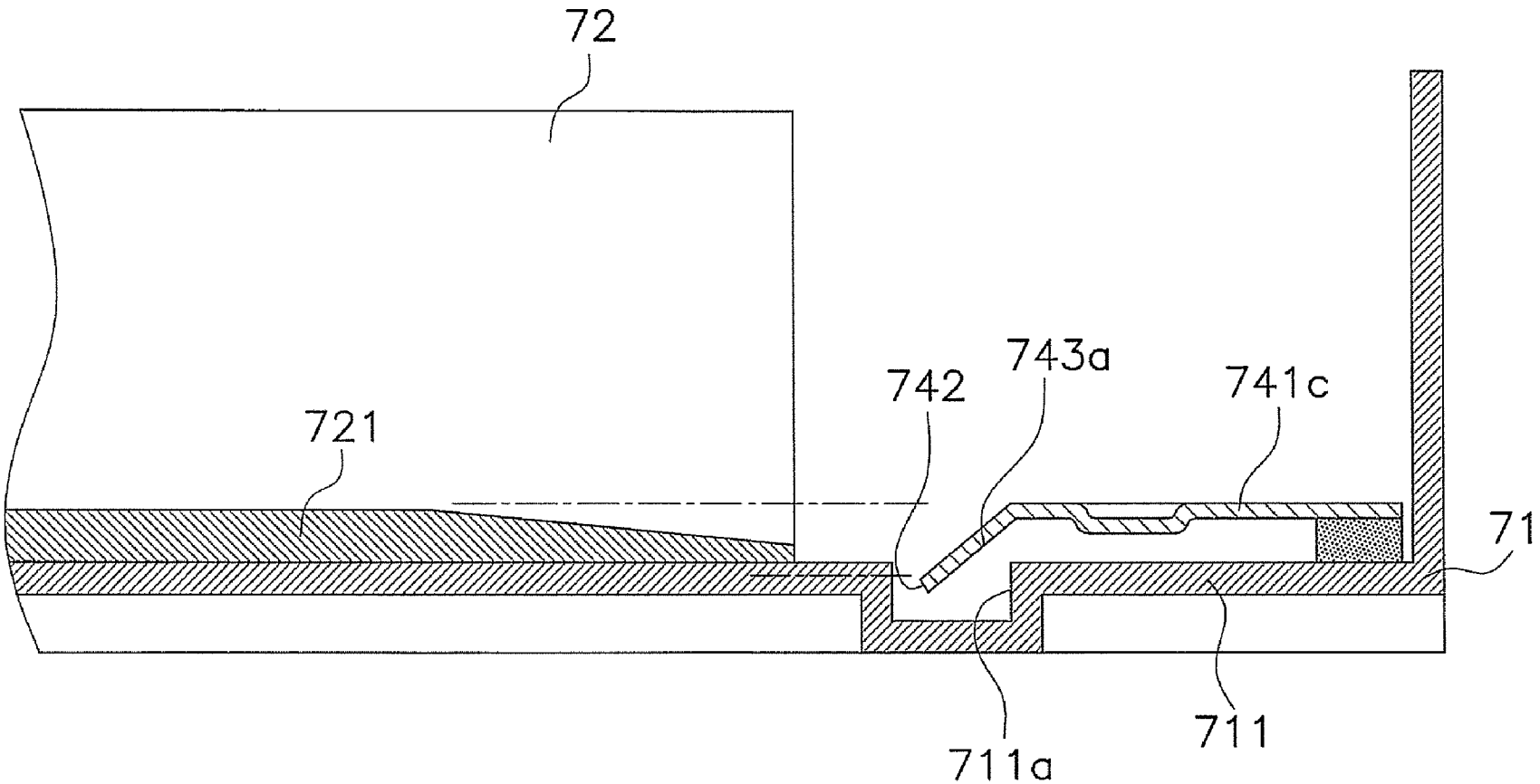
FIG. 5 is a cross-sectional view of a frame and a first paper disposition plate of the paper feeder cassette.

As illustrated in FIG. 5, the edge portion 742 is a portion disposed on the upstream side of the second width direction portion 741*c* in the paper transporting direction, and extends along a direction approximately or exactly perpendicular to the paper transporting direction. The edge portion 742 is disposed closer to the bottom portion 711 than to the support disposition portion 721 under the condition that a plurality of sheets of paper is disposed on the paper disposition portion 741.

The contact avoidance portion 743 is a portion that is configured to prevent a plurality of sheets of paper from getting stuck with the edge portion 742 when disposition of the sheets of paper is performed while being slid along the paper transporting direction, and includes an avoidance plate portion 743*a* and a twisted portion 743*b*. The avoidance plate portion 743*a* is formed between the edge portion 742 and the second width direction portion 741*c*, and is a portion formed by bending down the upstream side end portion of the second width direction portion 741*c* in the paper transporting direction. As illustrated in FIG. 5, due to the existence of the contact avoidance portion 743, the edge portion 742 is positioned below the height position of the support disposition portion 721 of each of the pair of the support plates 72. The twisted portion 743*b* is a portion provided on the upstream side of the hole 741*g* in the paper transporting direction, and is a portion connecting the upstream side portion of the avoidance plate portion 743*a* in the paper transporting direction and the first longitudinal direction portion 741*b*. The twisted portion 743*b* is formed in a twisted shape. This is because the twisted portion 743*b* is formed to connect the bent tip portion of the avoidance plate portion 743*a* and the flat portion of the first longitudinal direction portion 741*b*. A part of the hole 741*g* is cut out, that is, opened by the twisted portion 743*b*, and accordingly strength reduction is prevented.

Alignment Plate

As seen in FIG. 2, the alignment plate 75 is a member that is configured to align a sheet of paper in the paper transporting direction, and is disposed to slide from the fourth wall 715 to the third wall 714. In addition, the alignment plate 75 is a member that extends in a direction approximately perpendicular to the bottom portion 711, and is a member that is configured to support a longitudinal end of a sheet of paper.

Recessed Portion of First Paper Disposition Plate

Figure 7A:
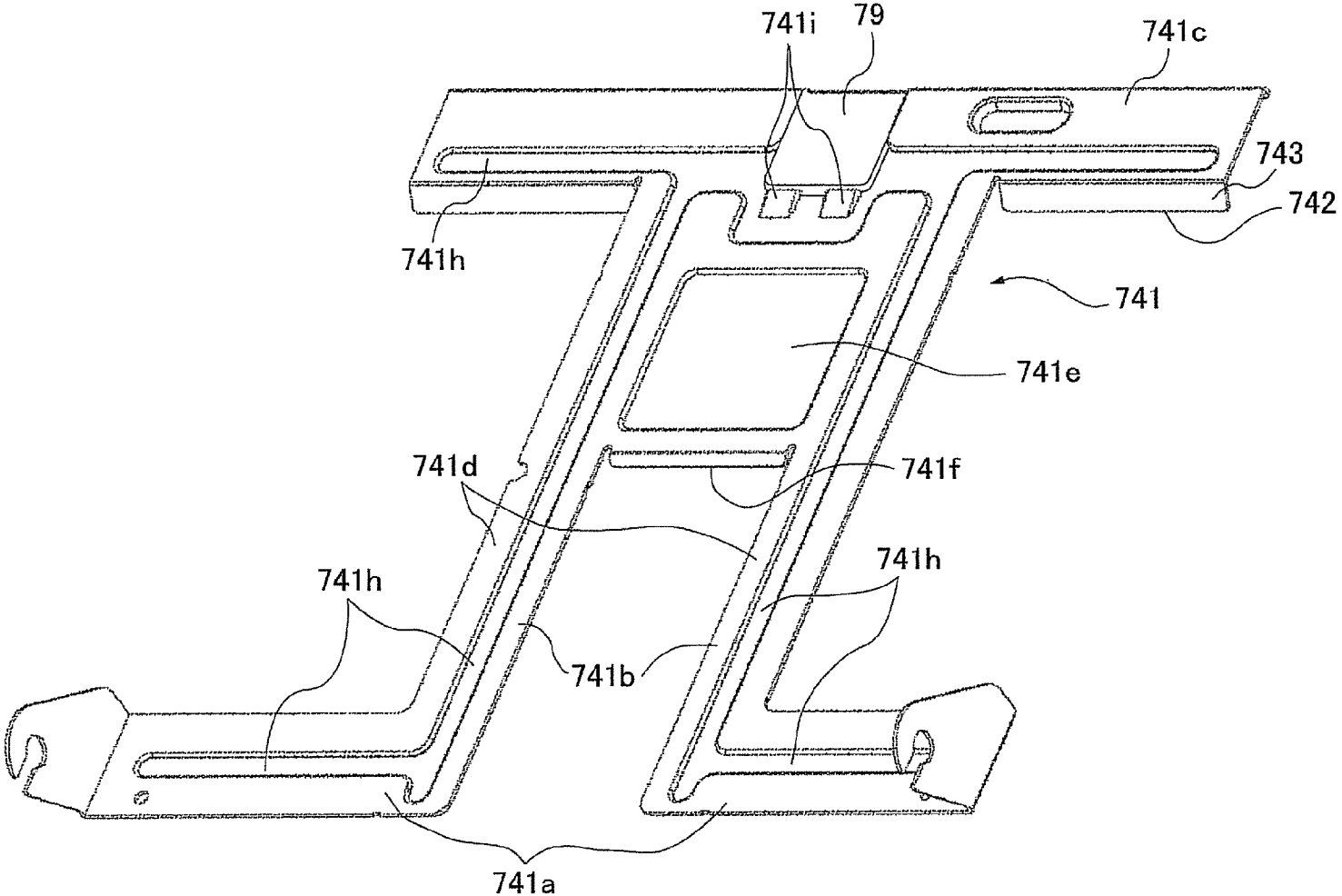
FIG. 7A is a perspective view illustrating a paper disposition plate of a modified example of the first embodiment.

Here, as illustrated in FIG. 7A in detail, a plurality of recessed portions 741*h* is formed in a flat part of the first paper disposition plate 74 for the purpose of reinforcing the first paper disposition plate 74, and is preferably formed by drawing. The recessed parts 741*h* are formed in an approximately linear shape in a pair of elongated plate portions 741*d*, the first width direction portion 741*a*, and the second width direction portion 741*c*. It is possible to enhance strength against deflection and torsion of the first paper disposition plate 74 by coupling the recessed parts 741*h* to each other.

Note that FIG. 7A is a diagram for illustrating a modified example of the first embodiment. However, the recessed parts formed in the first paper disposition plate 74 of the first embodiment will be herein explained with reference to FIG. 7A for the sake of convenience.

An area to which a friction member 79 is attached is formed in the recessed portion 741*h*, specifically, in the center part of the second width direction portion 741*c*. The friction member 79 is formed in a rectangular shape and its thickness is slightly less than the depth of the recessed portion 741*h*. The friction member 79 is made of the material having a relatively high friction coefficient. The friction member 79 is provided to prevent a plurality of sheets of paper from being simultaneously transported while the sheets of paper are overlapped. The friction member 79 is disposed to be opposed to a roller (not illustrated in the figure) that is disposed above and is configured to feed a sheet of paper forward, and is also disposed to make contact with the bottom surface of a sheet of paper to be transported. In addition, two sloped portions 741*i* are formed in the positions adjacent to the side portion of the friction member 79 on the upstream side in the paper transporting direction. The sloped portions 741*i* are formed by cutting and rearing a part of the bottom surface of the recessed portion 741*h*. The sloped portions 741*i* protrude to the upper surface side of the recessed portion 741*h* from the upstream side to the downstream side in the paper transporting direction. The height of the downstream side end portion of each sloped portion 741*i* is approximately the same as that of the flat portion of the first paper disposition plate 74, and is slightly higher than that of the friction member 79.

Figure 7B:
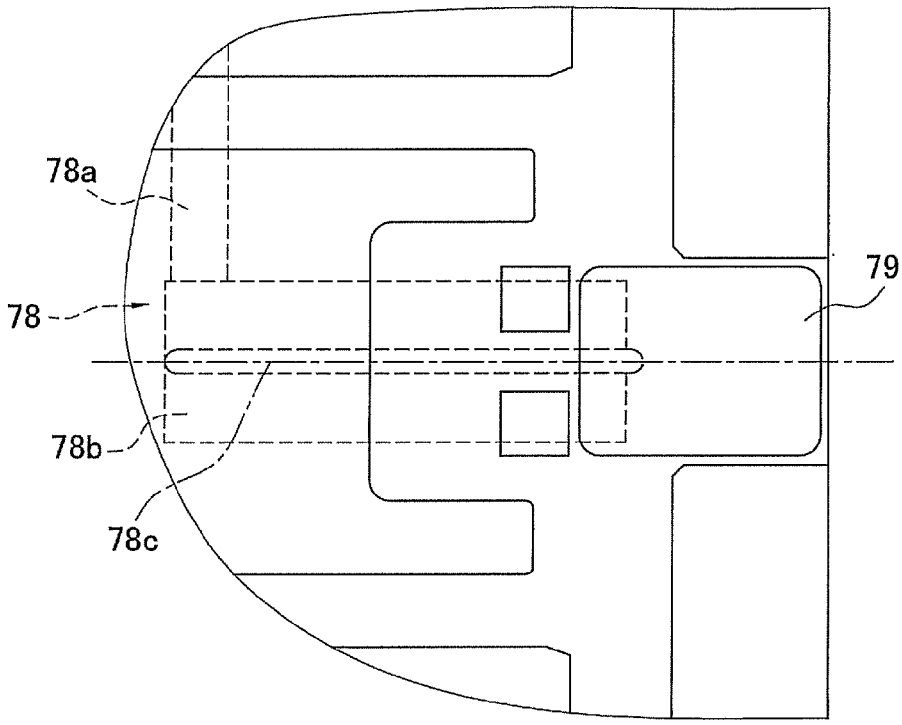
FIG. 7B is an enlarged partial plan view of the paper disposition plate illustrated in FIG. 7A.
Figure 7C:
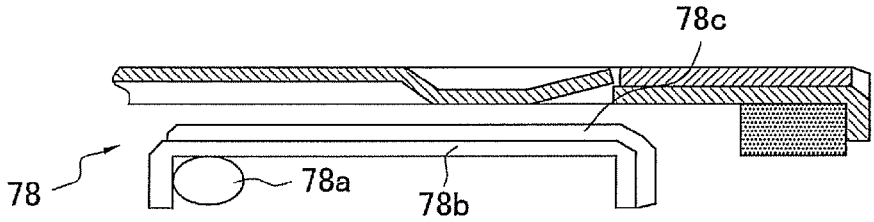
FIG. 7C is an enlarged partial cross-sectional view of the paper disposition plate illustrated in FIG. 7A.
Figure 7D:
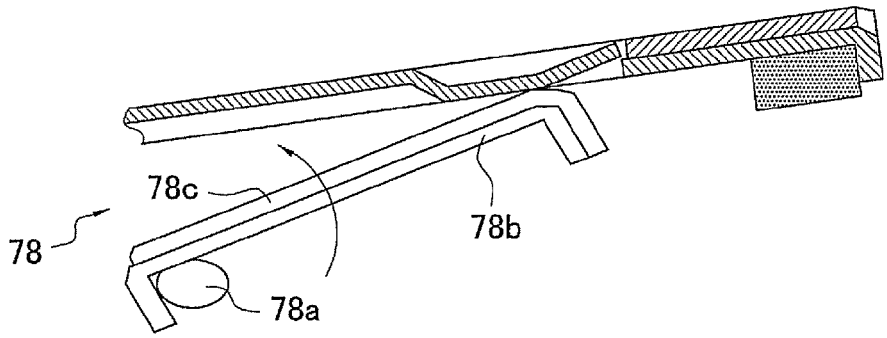
FIG. 7D is another enlarged partial cross-sectional view of the paper disposition plate illustrated in FIG. 7A.

As illustrated in FIGS. 7B, 7C, and 7D, a lifting mechanism 78 is provided below a vicinity of the friction member 79 of the first paper disposition plate 74. The lifting mechanism 78 includes a driving shaft 78*a* and a lifting plate 78*b*. The lifting plate 78*b* is fixed to the end of the driving shaft 78*a*. The lifting plate 78*b* is a plate member formed in a rectangular shape, and a projection 78*c* is preferably formed on the center part of the lifting plate 78*b* by drawing. Preferably, the lifting plate 78*b* extends underneath portions of the sloped portions 741*i* and the friction member 79. Further, the projection 78*c* preferably extends between and underneath the sloped portions 741*i* and underneath a portion of the friction member 79. The driving shaft 78*a* is rotatably held by the frame 71, and its tip protrudes from the second wall 713. A coupling member (not illustrated in the figure) is attached to the protruded portion. The coupling member is configured to be coupled to a driving member of the device body when the paper feeder cassette is mounted to the device body of the color printer 1. With the configuration, when the driving shaft 78*a* is rotated, the projection 78*c* of the lifting plate 78*b* makes contact with the lower surface of the recessed portion of the first paper disposition plate 74, and thus the lifting plate 78*b* is lifted up (see FIGS. 7C and 7D).

Referring to FIGS. 7A-7D, note that the friction member 79 does not protrude from the first paper disposition plate 74 in the paper transport direction. Furthermore, the side edge of each of the sloped portions 741*i* is disposed to be adjacent to and positioned higher than the upstream side's end of the friction member 79. Accordingly, a plurality of sheets of paper does not get stuck to the friction member 79 when supplied.

Also, the recessed portion 741*h* is provided in the second width direction portion 741*c*. However, the contact avoidance portion 743 is provided to be adjacent to the recessed portion, and a plurality of sheets of paper is guided upward by the contact avoidance portion 743. Therefore, the end of a plurality of sheets of paper do not easily fall into the recessed portion 741*h* of the second width direction portion 741*c*.

Operation

Referring to FIG. 1, when image information is transmitted to the color printer 1 from an externally connected computer and the like, an electrostatic latent image is formed on the photosensitive drum 21 based on the transmitted image information. Then, toner is supplied to the electrostatic latent image formed on the photosensitive drum 21 from the developing device 22, and thus a toner image is formed on the photosensitive drum 21. The toner image is transferred onto the intermediate transfer belt 81. Here, a sheet of paper is transported from the paper feeding section 6 to a position where the sheet of paper makes contact with the intermediate transfer belt 81. Specifically, as seen in FIGS. 1 and 2, the first paper disposition plate 74 rotates around its portion supported by the pair of support plates 72 by a motor (not illustrated in the figure), and a sheet of paper disposed on the first paper disposition plate 74 is moved to a position where the sheet of paper is allowed to be fed to the paper transporting section 3. The sheet of paper moved to the position is fed to the paper transporting section 3, and is transported to a position where it makes contact with the intermediate transfer belt 81 by the paper transporting section 3. Next, the toner image on the intermediate transfer belt 81 is transferred onto the sheet of paper, and the sheet of paper onto which the toner image is transferred is transported to the fixing section 4. Then, the toner image is fixed on the sheet of paper by the fixing section 4, and the sheet of paper onto which the toner is fixed is discharged to the outside of the color printer 1.

An operation for supplying a plurality of sheets of paper to the paper feeder cassette 7 will be hereinafter explained.

When a plurality of sheets of paper is supplied to the paper feeder cassette 7, the paper feeder cassette 7 is pulled to the front side of the color printer 1 while the drawer-pull (not illustrated in the figure) of the first wall 712 of the paper feeder cassette 7 is held. Then, positions of the pair of the support plates 72 are regulated depending on the size of the sheets of paper, and the sheets of paper are inserted between the pair of support plates 72 from the above. Alternately, disposition of a plurality of sheets of paper may be performed as follows. That is, the sheets of paper are inserted between the pair of support plates 72 from the above of the pair of support plates 72 so as to be located on the fourth wall 715 side. Then, the sheets of paper are slid toward the third wall 714 side between the pair of support plates 72. After the disposition, the sheets of paper may be aligned by the alignment plate 75.

Here, the height position of the edge portion 742 of the first paper disposition plate 74 is positioned below that of the support disposition portion 741. Therefore, it is possible to prevent a plurality of sheets of paper from getting stuck to the edge portion 742. In addition, it is possible to prevent strength reduction of the first paper disposition plate 74 by forming the twisted portion 743*b*, even when the hole 741*g* for a sensor is formed in the second width direction portion 741*c* of the first paper disposition plate 74. Furthermore, as seen in FIGS. 2 and 3, the groove 711*a* that the edge portion 742 and the contact avoidance portion 743 are configured to enter is formed on the bottom portion 711. Accordingly, it is possible to prevent the edge portion 742 from making contact with the bottom portion 711.

Figure 6:
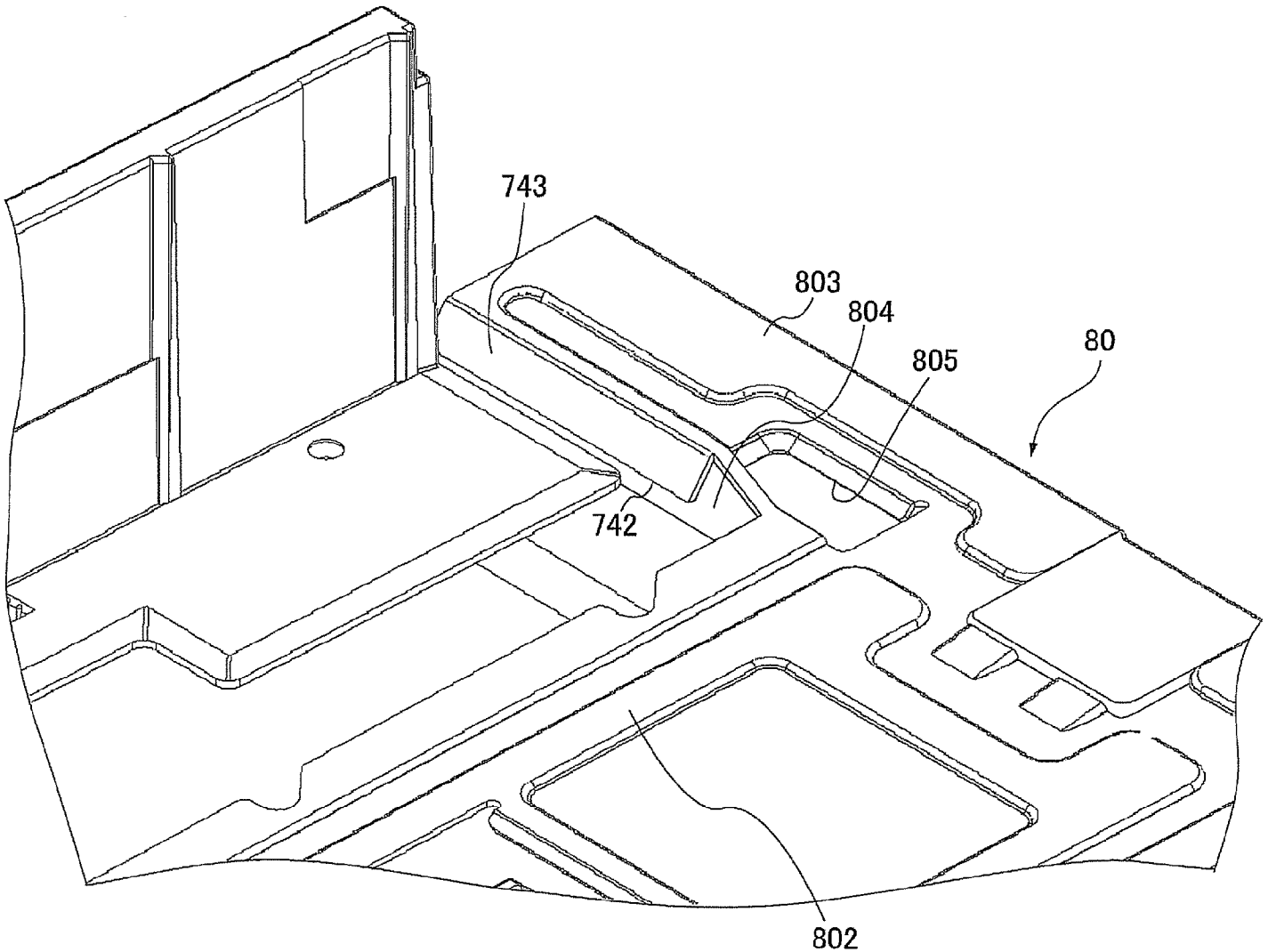
FIG. 6 is a perspective view illustrating a cutout and its periphery of the paper disposition plate of a modified example of the first embodiment.

In the above described embodiment, the first paper disposition plate 74 is used, in which the front side of the twisted portion 743*b* in the paper transporting direction is formed to extend in a direction in which the edge portion 742 extends. The present invention is not limited to the configuration. For example, as illustrated in FIG. 6, a second paper disposition plate 80 may be used, which include a third width direction portion that is a portion formed on the upstream side end of the second paper disposition plate 80 in the paper transporting direction (not illustrated in FIG. 6), a second longitudinal direction portion 802, a fourth width direction portion 803, and a connection portion 804.

Here, the third width direction portion and the second longitudinal direction portion 802 have the same or similar configurations as those of the first width direction portion 741*a* and the first longitudinal direction portion 741*b* of the above described embodiment. Therefore, explanation of the portions will be hereinafter omitted. The fourth width direction portion 803 is a portion extending in the width direction. In addition, a cutout 805 is formed in a connection portion between the fourth width direction portion 803 and the second longitudinal direction portion 802 so as to extend in the paper transporting direction. The connection portion 804 is provided to cross the cutout 805, and is formed to be gradually sloped from the fourth width direction portion 803 toward the front side in the paper transporting direction and finally to connect to the second longitudinal portion 802 while it is located adjacent to the end of the edge portion 742. Here, it is possible to reduce simultaneously the area where a plurality of sheets of paper makes contact with the connection portion 804 when the plurality of sheets of paper is disposed while being slid in the paper transporting direction. In other words, a plurality of sheets of paper and the connection portion 804 are not configured to be parallel to each other because the connection portion 804 is sloped toward the end of the plurality of sheets of paper in the paper transporting direction. Accordingly, it is possible to prevent a plurality of sheets of paper from easily getting stuck to the connection portion 804.

Also, in the above described embodiment, the hole 741*g* for a sensor is provided in the second width direction portion 741*c*. However, the present invention is not limited to the configuration. For example, as illustrated in FIG. 7A, a first paper disposition plate 741 without the hole 741*g* may be used by disposing a sensor in a position except for the position below the first paper disposition portion 741.

2. Second Embodiment

A second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

Figure 8:
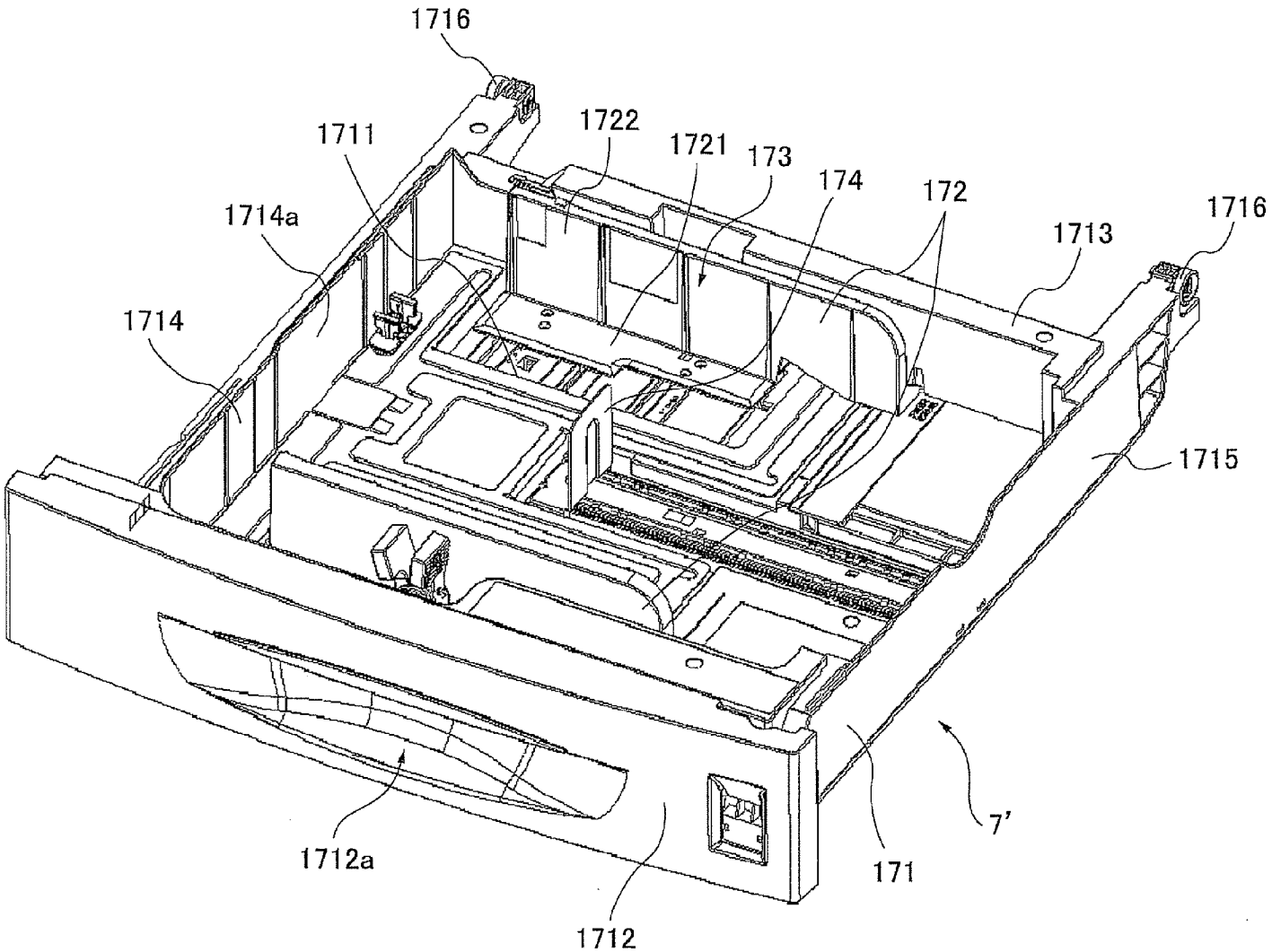
FIG. 8 is a perspective view of an entire paper feeder cassette according to a second preferred embodiment of the present invention.
Figure 9:
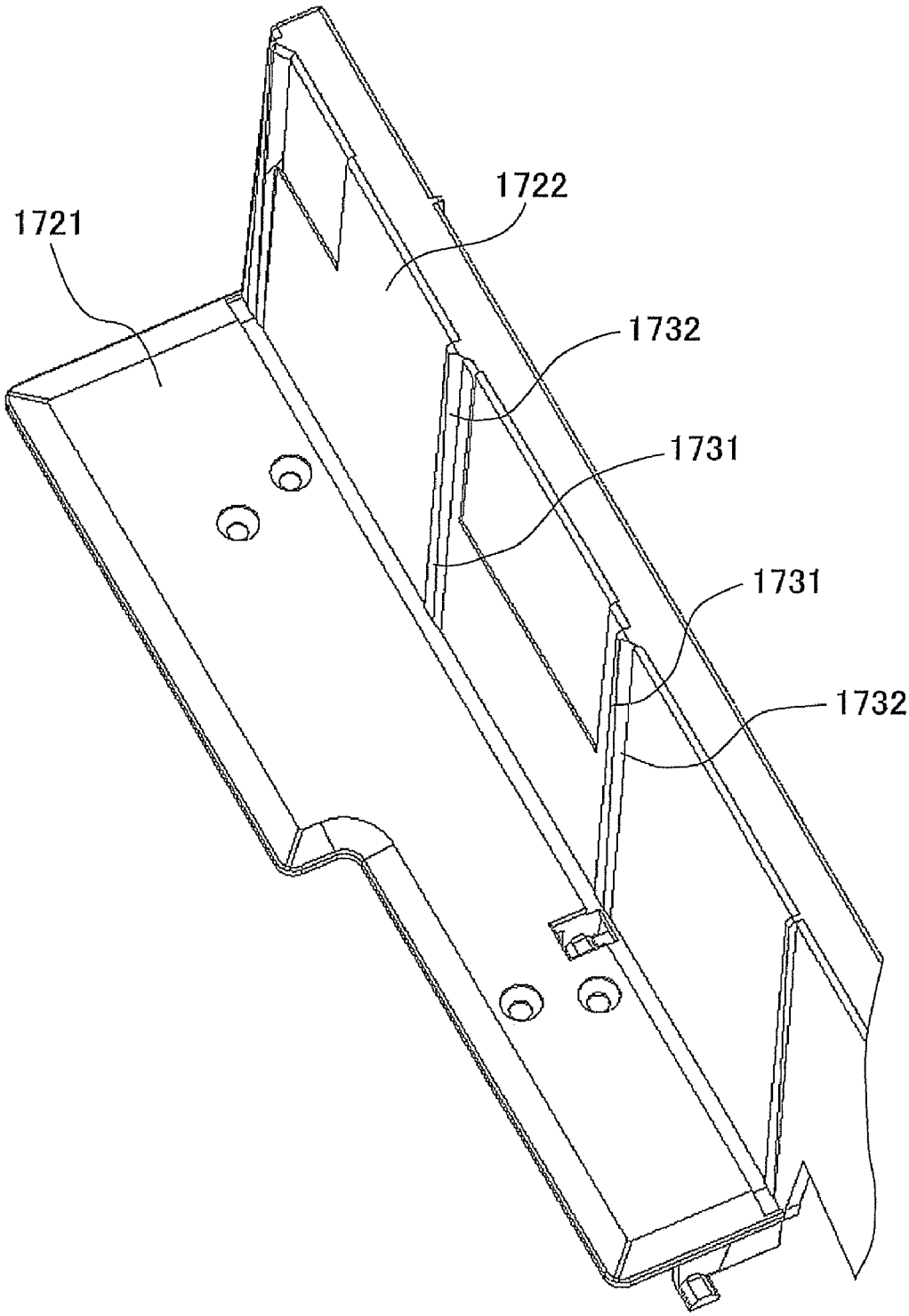
FIG. 9 is a partial perspective view showing the support plate of the paper feeder cassette of the second embodiment seen from the above.
Figure 10:
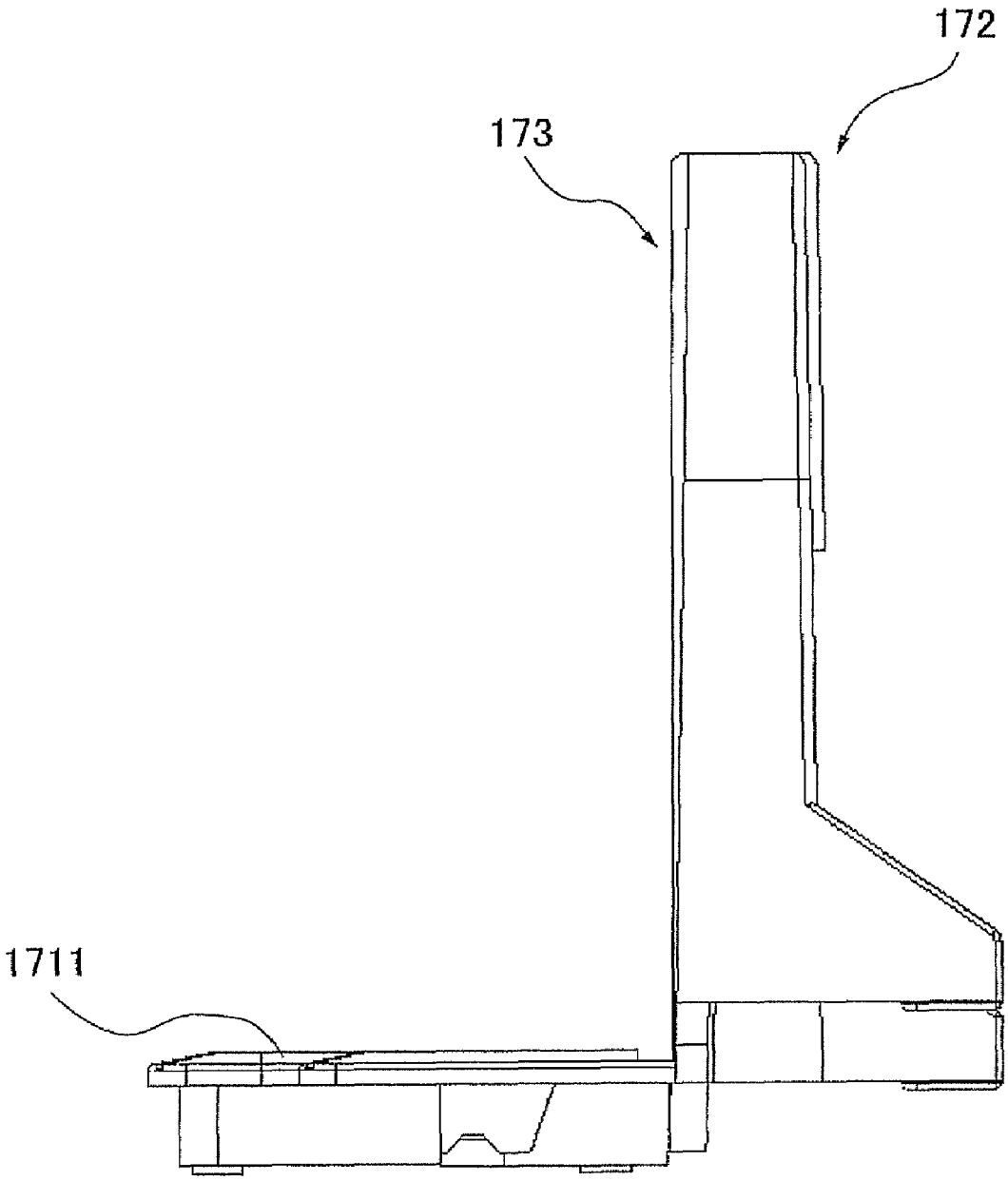
FIG. 10 is a view of the support plate of the paper feeder cassette of the second embodiment seen from a lateral side.

FIGS. 8-10 illustrate a paper feeder cassette of an image forming device (color printer) according to the second preferred embodiment of the present invention. Note that configuration of the image forming device of the second embodiment is the same as or similar to that of the first embodiment excluding the paper feeder cassette. Therefore, only the paper feeder cassette of the second embodiment will be hereinafter explained.

As described in FIG. 8, a paper feeder cassette 7' includes a frame 171, a pair of support plates 172, and an alignment plate 174.

The frame 171 is a box shaped member, and includes a paper disposition plate 1711, a first wall 1712, a second wall 1713, a third wall 1714, and a fourth wall 1715. In addition, the frame 171 includes a plurality of rollers 1716 on the rear side of the color printer, and the rollers 1716 serve to make it easy to pull the paper feeder cassette 7' out of the color printer, The paper disposition plate 1711 is a member that is disposed on the bottom part of the frame 171, and is configured to dispose a plurality of sheets of paper thereon. Here, a plurality of sheets of paper is disposed in a position where the sheets of paper are allowed to be fed to the paper transporting section 3. Specifically, the sheets of paper are disposed between the pair of the support plates 172, and are also disposed between the alignment plate 174 and the third wall 1714 of the frame 171. The first wall 1712 is a member that is disposed on the front side of the color printer. A drawer-pull 1712*a*, which is allowed to be held when the paper feeder cassette 7' is pulled out of the color printer, is formed in the first wall 1712. The second wall 1713 is disposed to be opposed to the first wall 1712, and is a member that is disposed on the rear side of the color printer. The third wall 1714 is a member that is disposed between the first wall 1712 and the second wall 1713. A support surface 1714*a* that supports the longitudinal end of a plurality of sheets of paper is formed on the third wall 1714. The fourth wall 1715 is disposed between the first wall 1712 and the second wall 1713, and is a member disposed to be opposed to the third wall 1714.

The pair of the support plates 172 is a pair of members that supports both lateral sides of a plurality of sheets of paper, specifically, both ends of a plurality of sheets of paper in a direction perpendicular to the longitudinal direction (i.e., paper width direction). The pair of the support plates 172 is disposed to move in the paper width direction. In addition, the pair of the support plates 172 includes a bottom portion 1721 and a support portion 1722 (lateral portion).

The bottom portion 1721 is a portion making contact with the paper disposition plate 1711, and is a portion that disposes a part of a plurality of sheets of paper thereon. The bottom portion 1721 is attached to the paper disposition plate 1711 in parallel with the paper disposition plate 1711 so as to slide with respect to the paper disposition plate 1711 in the paper width direction. The support portion 1722 is provided in a direction approximately perpendicular to the bottom portion 1721, and the surface of the support portion 1722, which is opposed to a plurality of sheets of paper, is formed to be sloped from the bottom portion 1721 so as to be gradually remote from the sheets of paper. In addition, the support portion 1722 includes a plurality of support projections 173. The support projection 173 is a portion that supports a plurality of sheets of paper with its tip, and is a portion projecting from the support portion 1722 of each of the pair of support plates 172 toward a plurality of sheets of paper when the sheets of paper are disposed on the paper disposition plate 1711. In addition, the support projection 173 is formed from the bottom to the top of the support portion 1722 in the vertical direction, and the horizontal position of the projecting end of the support projection 173 is configured to be uniform regardless of its height.

Here, as described above, the surface of the support portion 1722, which is opposed to a plurality of sheets of paper, is formed to be sloped from the bottom portion 1721 so as to be gradually remote from the sheets of paper. Accordingly, as illustrated in FIG. 10, the amount of protrusion of the support protrusion 173 gradually increases upward in the vertical direction. Thus, the support plate 172 is formed to have the mold draft angle sloped upward from the bottom portion 1721. Furthermore, a plurality of support projections 173 are herein disposed to be aligned at predetermined intervals in a direction that the support plate 172 extends. As described in FIG. 9, three of the plurality of support projections 173, which are located on the third wall 1714 side, include a contact surface 1731 (paper abutment surface) and a taper surface 1732 (insertion guide lateral surface), respectively. The contact surface 1731 is formed on the tip of the support projection 173 in the projecting direction, and is a surface opposed to the lateral side of a plurality of sheets of paper. In addition, the contact surface 1731 is formed to have a width that is gradually reduced upward in the vertical direction, and is also formed in a flat and smooth shape. Thus, the support plate 172 is formed to have the mold draft angle sloped upward from the bottom portion 1721. The taper surface 1732 is formed to prevent a plurality of sheets of paper from easily getting stuck with the support projection 173 when the sheets of paper are inserted in the paper disposition position while being slid between the pair of the support plates 172. The taper surface 1732 is formed on the lateral surface of the support projection 173 on the fourth wall 1715 side. In addition, the taper surface 1732 is formed to be gradually steeply-sloped upward in the vertical direction. Specifically, the taper surface 1732 is provided to be sloped from the tip of the support projection 173 in the protruding direction to the support portion 1722.

The alignment plate 174 is a member that accurately disposes a plurality of sheets of paper in the paper disposition position, and is disposed to slide between the third wall 1714 and the fourth wall 1715. In addition, the alignment plate 174 is a member extending in a direction approximately perpendicular to the paper disposition plate 1711, and is a member that supports a longitudinal end of a plurality of sheets of paper.

In the second embodiment, when a plurality of sheets of paper is supplied to the paper feeder cassette 7', the drawer-pull 1712*a* of the first wall 1712 of the paper feeder cassette 7' is held, and the paper feeder cassette 7' is pulled to the front side of the color printer. Then, positions of the pair of the support plates 172 are regulated in accordance with the size of a sheet of paper, and a plurality of sheets of paper is inserted between the pair of the support plates 172 from the above. Alternately, a plurality of sheets of paper is disposed between the pair of the support plates 172 from above the pair of the support plates 172 so as to be positioned on the fourth wall 1715 side, and are then slid between the pair of the support plates 172 toward the third wall 1714 side. Next, the sheets of paper are aligned by the alignment plate 174.

Here, when a plurality of sheets of paper is disposed, the sheets of paper do not easily get stuck with the support projection 173. Accordingly, it becomes easy to dispose a plurality of sheets of paper on the paper disposition plate.

Note that in the above described embodiments, the taper surface 1732 is formed only for three of the plurality of support projections 173 on the third wall 1714 side, respectively. However, the present invention is not limited to the configuration. For example, the taper surface 1732 may be formed for each of all the support projections 173.

In the above described embodiments, a case that the present invention is applied to the color printer is exemplified. However, the present invention is not limited to this, and may be applicable to a photocopier and a multi-function peripheral (MPF) as well.

General Interpretation

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applied to words having similar meanings such as the terms, "including," "having," and their derivatives. Also, the term "part," "section," "portion," "member," or "element" when used in the singular can have the dual meaning of a single part or a plurality of parts. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A paper feeder cassette being configured to be attached to an image forming device, the paper feeder cassette being configured to store a plurality of sheets of paper to be transported to an image forming section of an image forming device, comprising:

a bottom part;

a pair of support plates being configured to move relative to the bottom part, the pair of support plates supporting both lateral sides of the sheets of paper in a paper width direction perpendicular to a paper transporting direction; and a paper disposition plate being disposed above the bottom part, the paper disposition plate being configured to dispose the sheets of paper thereon, the paper disposition plate including an edge portion being provided to extend along a direction approximately perpendicular to the paper transporting direction on a downstream side of the pair of the support plates in the paper transporting direction, and a contact avoidance portion being configured to prevent the sheets of paper from making contact with the edge portion when disposition of the sheets of paper are performed by sliding the sheets of paper along the paper transporting direction.

2. The paper feeder cassette of claim 1, wherein the pair of support plates includes a support disposition portion configured to dispose a part of the sheets of paper thereon, the paper disposition plate further includes paper disposition portions disposed in parallel with each other on the bottom part, the contact avoidance portion is provided between the paper disposition portion and the edge portion and is formed to be bent from the paper disposition portion to the bottom portion side, and the edge portion is positioned below the height position of the support disposition portion of the pair of the support plates by the contact avoidance portion.

3. The paper feeder cassette of claim 2, wherein an upstream side end of the paper disposition plate in the paper transporting direction is rotatably supported.

4. The paper feeder cassette of claim 1, wherein the bottom part includes a groove portion, the groove portion configured to receive the edge portion and the contact avoidance portion by insertion.

5. The paper feeder cassette of claim 2, wherein the paper disposition portion includes an opening in the vicinity of the contact avoidance portion, and the contact avoidance portion includes a twisted portion, the twisted portion is provided to connect a bent portion and the paper disposition portion, and the twisted portion forms a part of a brim of the opening.

6. The paper feeder cassette of claim 1, wherein the paper disposition plate includes a first width direction portion being provided on an upstream side end of the paper disposition plate in the paper transporting direction, the first width direction portion extending in the paper width direction, a longitudinal direction portion extending from the first width direction portion to the downstream side in the paper transporting direction, a second width direction portion including a cutout in a portion connected to the longitudinal direction portion, the second width direction portion being provided on a downstream side end of the longitudinal direction portion in the paper transporting direction, the second width direction portion extending in the paper width direction, and a connection portion for connecting the second width direction portion and the longitudinal direction portion, the connection portion being bridged between the second width direction portion and the longitudinal direction portion in an oblique direction with respect to the paper width direction so as to cross the cutout.

7. An image forming device, comprising:

a paper feeder cassette being configured to store a sheet of paper to be used for printing, the paper feeder cassette including a bottom part, a pair of support plates being configured to move relative to the bottom part, the pair of support plates supporting both lateral sides of the sheets of paper in a paper width direction perpendicular to a paper transporting direction, and a paper disposition plate being disposed above the bottom part, the paper disposition plate being configured to dispose the sheets of paper thereon, the paper disposition plate including an edge portion and a contact avoidance portion, the edge portion being provided to extend along a direction approximately perpendicular to the paper transporting direction on the downstream side of the pair of the support plates in the paper transporting direction, the contact avoidance portion being configured to prevent the sheets of paper from making contact with the edge portion when disposition of the sheets of paper are performed by sliding the sheets of paper along the paper transporting direction, an image forming section being configured to form an image on the sheets of paper, and a paper transporting section being configured to transport the sheets of paper stored in the paper feeder cassette to the image forming section.

8. A paper feeder cassette being configured to be attached to an image forming device, the paper feeder cassette being configured to store a plurality of sheets of paper to be used for printing, comprising:

a paper disposition plate being configured to dispose the sheets of paper thereon; and a pair of support plates being configured to support both lateral sides of the sheets of paper disposed on the paper disposition plate in a paper width direction, each of the pair of support plates including a lateral portion having a predetermined height, the lateral portion extending in a paper transporting direction perpendicular to the paper width direction, the lateral portion being opposed to a lateral side of the sheets of paper, and a support projection being formed to project from the lateral portion toward the sheets of paper, the support projection being configured to make contact with the lateral side of the sheet of paper, the support projection having an insertion guide lateral surface on the upstream side in a paper insertion direction, the insertion guide lateral surface being sloped from a paper abutment surface of the support projection to the lateral portion.

9. The paper feeder cassette of claim 8, wherein the insertion guide lateral surface is formed to have mold draft angle sloped upward from the bottom part.

10. The paper feeder cassette of claim 8, wherein a surface of the lateral portion opposed to the lateral side of the sheets of paper is formed to have mold draft angle sloped upward from the bottom part.

11. The paper feeder cassette of claim 8, wherein a downstream side lateral surface of the support projection in the paper insertion direction is formed to have mold draft angle sloped upward from the bottom part.

12. The paper feeder cassette of claim 8, wherein each of the pair of the support plates further includes a bottom portion on the bottom of the lateral portion, the bottom portion is integrally formed with the lateral portion, the bottom portion is attached to be in parallel with the paper disposition plate, and the bottom portion is attached to slide in the paper width direction with respect to the paper disposition plate.

13. An image forming device, comprising:

a paper feeder cassette being configured to store a plurality of sheets of paper to be used for printing, the paper feeding cassette including a paper disposition plate being configured to dispose the sheets of paper thereon, and a pair of support plates being configured to support both lateral sides of the sheets of paper disposed on the paper disposition plate in a paper width direction, each of the pair of support plates including a lateral portion having a predetermined height, the lateral portion extending in a paper transporting direction perpendicular to the paper width direction, the lateral portion being opposed to a lateral side of the sheets of paper, and a support projection being formed to project from the lateral portion toward the sheets of paper, the support projection contacting the lateral side of the sheets of paper, the support projection having an insertion guide lateral surface on the upstream side in a paper insertion direction, the insertion guide lateral surface being sloped from a paper abutment surface of the support projection to the lateral portion;

an image forming section being configured to form an image on the sheet of paper; and a paper transporting section being configured to transport the sheets of paper stored in the paper feeder cassette to the image forming section.

14. A paper feeder cassette being configured to be attached to an image forming device, the paper feeder cassette being configured to store a plurality of sheets of paper to be transported to an image forming section of the image forming device, comprising:

a bottom part;

a paper disposition plate including a flat portion being disposed above the bottom part, the flat portion being configured to dispose the sheets of paper on the upper surface thereof, and and a recessed portion being formed in a part of the flat portion to protrude downward from the flat portion;

a friction member being configured to prevent a plurality of sheets of paper from being simultaneously transported from the paper disposition plate while the sheets of paper are overlapped, the friction member being configured to make contact with the bottom surface of the sheets of paper to be transported from the paper disposition plate; and a sloped member being disposed on the upstream side of the friction member in a paper transporting direction so as to be adjacent to the friction member, the sloped member having a surface sloped toward an upstream side in the paper transporting direction, the surface having a downstream side end in the transporting direction, the downstream side end being positioned higher than the friction member.

15. The paper feeder cassette of claim 14, wherein the friction member is disposed in the recessed portion of the paper disposition plate.

16. The paper feeder cassette of claim 14, further comprising a pair of support plates configured to move relative to the bottom part, the pair of support plates is configured to support the both lateral sides of the sheets of paper in a paper width direction perpendicular to the paper transporting direction.

17. The paper feeder cassette of claim 16, wherein the paper disposition plate includes an edge portion and a contact avoidance portion, the edge portion disposed along a direction approximately perpendicular to the paper transporting direction on the downstream side of the pair of the support plates in the paper transporting direction, the contact avoidance portion is configured to prevent a plurality of sheets of paper from making contact with the edge portion when disposition of the sheets of paper are performed by sliding the sheets of paper along the paper transporting direction, and the recessed portion is formed to be adjacent to the contact avoidance portion on the downstream side of the contact avoidance portion in the paper transporting direction.

* * * * *